US005230171A

United States Patent [19]

Cardaropoli

[11] Patent Number: 5,230,171

[45] Date of Patent: Jul. 27, 1993

[54] SHOE FASTENER

[76] Inventor: Paul R. Cardaropoli, 157 Hope St., Greenfield, Mass. 01301

[21] Appl. No.: 767,424

[22] Filed: Sep. 30, 1991

[51] Int. Cl.[5] ..... A43B 11/00

[52] U.S. Cl. ..... 36/50.1; 36/51

[58] Field of Search ..... 36/50, 51; 2/22

[56] References Cited

U.S. PATENT DOCUMENTS

| | | | |
|---|---|---|---|
| 205,571 | 7/1878 | Northrup | 36/51 |
| 356,502 | 1/1887 | Rauh | 2/62 |
| 1,247,435 | 11/1917 | McHannan | 36/51 |
| 1,542,331 | 6/1925 | Brockway | 2/61 |
| 1,966,135 | 7/1934 | Reh | 36/50 |
| 1,969,527 | 8/1934 | Schnellbacher | 2/24 |
| 2,575,226 | 11/1951 | McHarry | 36/51 |
| 2,689,991 | 9/1954 | Fedankiw et al. | 36/50 |
| 3,037,303 | 6/1962 | Stever | 36/51 |
| 3,112,545 | 12/1963 | Williams | 36/51 |
| 4,157,622 | 6/1979 | Carlyle | 36/50 |
| 4,577,418 | 3/1986 | Nagy | 36/51 |
| 4,907,352 | 3/1990 | Ginsberg | 36/50 |
| 4,918,840 | 4/1990 | Nardulli | 36/51 |
| 5,148,614 | 9/1992 | Kelly | 36/50.1 |

FOREIGN PATENT DOCUMENTS

| | | | |
|---|---|---|---|
| 154958 | 3/1903 | Fed. Rep. of Germany | 36/51 |
| 927734 | 5/1955 | Fed. Rep. of Germany | 36/51 |
| 14746 | of 1896 | United Kingdom | 36/51 |

*Primary Examiner*—Steven N. Meyers

*Attorney, Agent, or Firm*—Chapin, Neal & Dempsey

[57] ABSTRACT

Shoe fastener for conventional type shoes having flaps with lace-receiving eyelets disposed along the upper edge portions thereof, includes an elastic web secured at one end to an elongated mounting plate. The plate has a plurality of bendable tabs to fit through the eyelets for securement to one flap of the shoe. At the other end thereof, the elastic web is affixed to a rectangular catch plate which includes an elongated slot. A latch plate, having tabs for fastening into the eyelets of the second flap, extends upwardly and outwardly from the flap for releasably interengagement with the slot in the catch plate. The elastic web, which extends from the mounting plate to the catch plate, may alternately be in the form of a unitary web of elastic fabric, a coil spring or flat spring, or more strands of an elastic material adapted to be affixed onto the retainer plate and the catch plate and when connected to the latch plate, will be in tensioned span on the instep portion of the shoe.

2 Claims, 2 Drawing Sheets

Fig.5
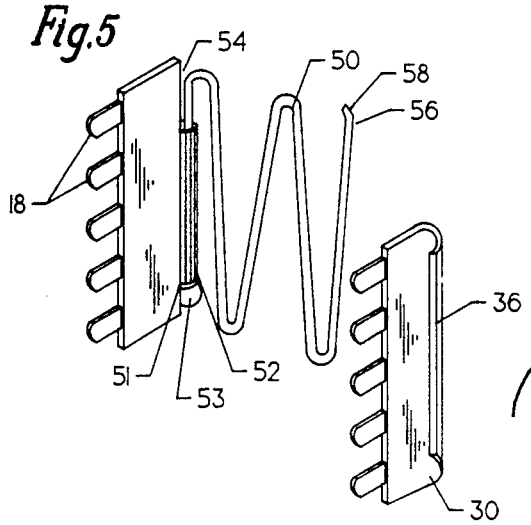
Fig.6
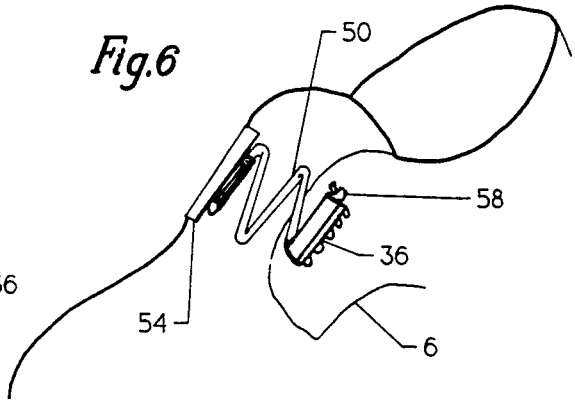
Fig.8
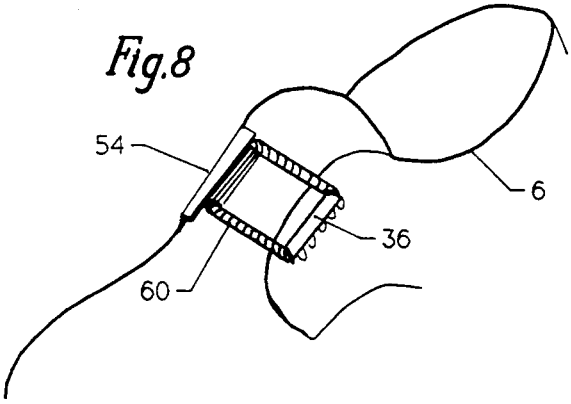
Fig.7
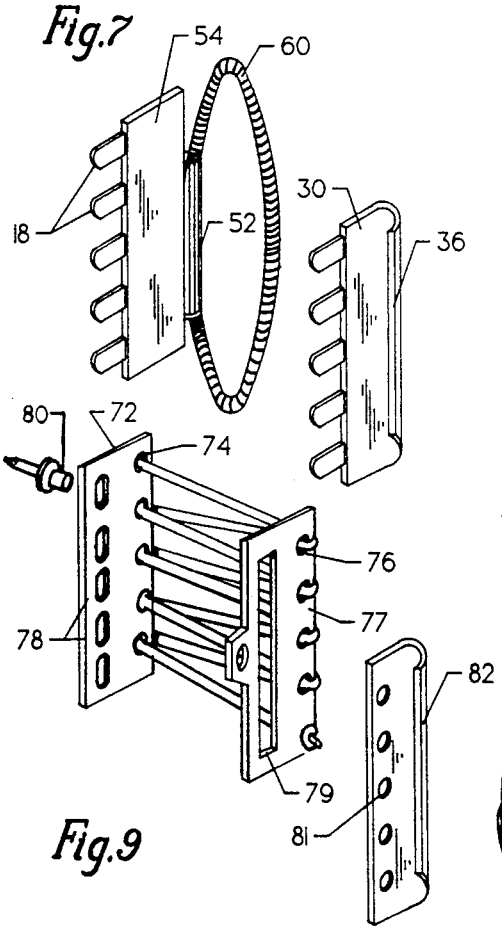
Fig.9
Fig.10
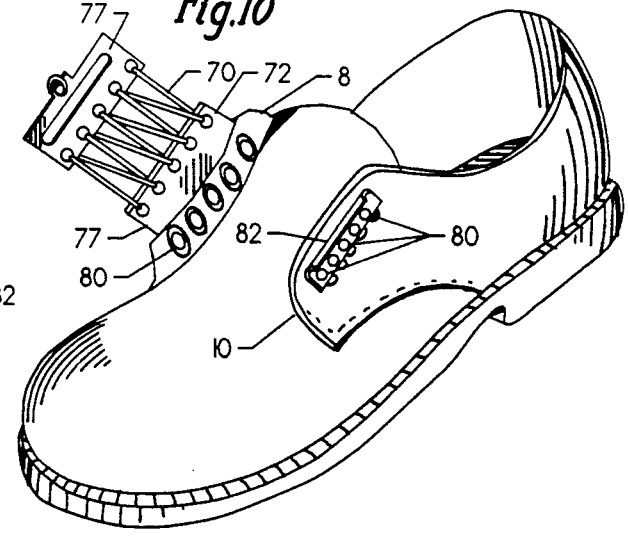

SHOE FASTENER

BACKGROUND OF THE INVENTION

This invention relates to shoe fasteners and more particularly to elastic or spring type fasteners adapted to replace the shoelaces used in existing, conventional type shoes or which may be installed by the manufacturer to replace shoes having lace type fasteners.

For many decades, a variety of different substitutes have been proposed in the prior art to replace the shoelace and, among others, have included elastic strands with hooks fitted onto the ends thereof to engage the eyelets provided along the shoe flaps for lacing up the shoe.

In U.S. Pat. No. 583,564 to Benford, there was disclosed in 1897, one such rudimentary concept which included a plurality of elastic bands, each of which included individual hooks at the outer ends to engage each of the eyelets of the shoe.

In 1909, U.S. Pat. No. 918,571 to Mauersberger disclosed an elongated keeper spring 11 which extends along the flaps on each side of the shoe. A number of resilient bands, each having a hook at opposite ends thereof, were provided to engage the keeper spring for holding the shoe in closed relation over the instep of the wearer's foot.

In 1942, U.S. Pat. No. 2,289,225 to Tonai disclosed a plurality of discrete rubber strands, each having a hook embedded at opposite ends thereof for fitting individually into the eyelets of the shoe flaps.

In 1958, U.S. Pat. No. 2,839,804 to Benoit disclosed a shoelace structure similar to Tonai, except that an anchor plate is provided for securing one end of each of the elastic bands in place on one flap of the shoe. In was still required, however, to fit individually the several hooks into the eyelets of the second flap.

In 1970, U.S. Pat. No. 3,550,218 to Woolner, apparently recognized the drawback of the prior art patents and proposed a fastener device comprised of an elastic band of sufficient width to span two adjacent lacing eyelets of the shoe. Nonetheless, at opposite ends thereof, each such band had a hook member with two legs so that each leg of each hook had to be individually fitted into each of two adjacent eyelets and then turned under the collar or flap of the shoe. It will readily be appreciated that this construction would require extensive and precise manipulation to close and open the shoe.

None of the prior art patents or practices of which applicant is aware has provided a simple and efficient shoe closure device in which the user need not handle a plurality of separate spring members nor take the pains to manipulate individually a plurality of hooks for fitting into each of the several eyelets of the shoe.

Accordingly, it is the principal object of this invention to provide an improved shoe fastener in which all the parts thereof are adapted to be fully assembled onto the shoe and which by one manipulation, can be fastened or unfastened.

It is another object of this invention is to provide a quick connect and disconnect fastener of the above type in which an optional ring which may be engaged by a hook on the end of an elongated wand for closing and opening the shoe to be used in the event the user has a range of motion disability which might inhibit the tying of his shoes.

A further object of this invention is to provide a shoe fastener which is adapted for ease of installation on the existing pairs of shoes with shoelace eyelets or which may be readily installed by a shoe manufacturer in lieu of shoelaces as an original equipment installation.

The above and other objects and advantages of this invention will be more readily apparent from the following description read in conjunction with the accompanying drawings in which:

FIGS. 5 and 6 are perspective views of an alternate embodiment of this invention.

FIGS. 7 and 8 are perspective views of another alternate embodiment of this invention.

FIGS. 9 and 10 are perspective views of a further alternate embodiment of this invention.

The preferred embodiment of a shoe fastener device of this invention is shown at 4 fitted onto a shoe 6 which includes flaps 8 and 10 which extend upwardly from the body of the shoe and include lace-receiving eyelets 12 disposed along their outer edge portions.

Figure 1:
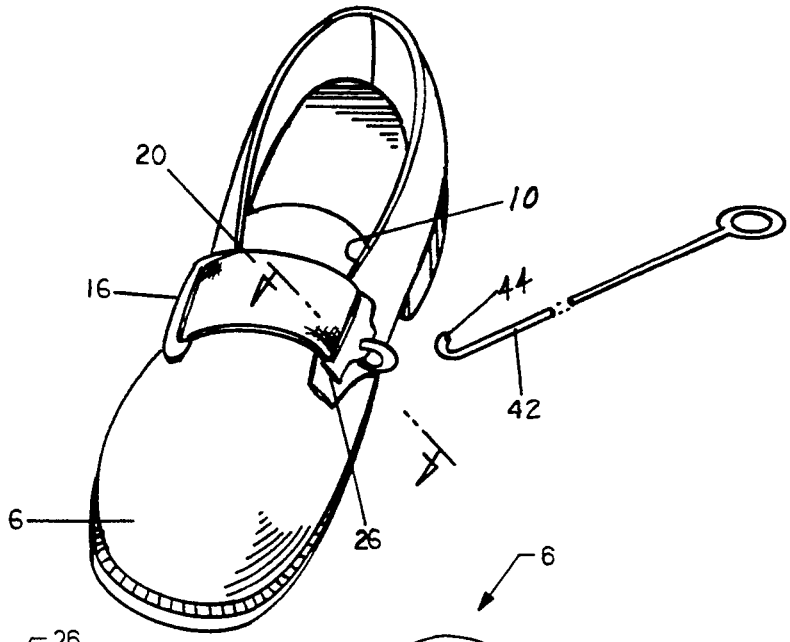
FIG. 1 is a perspective view of a shoe fitted with a fastener device of the type embodying this invention.
Figure 2:
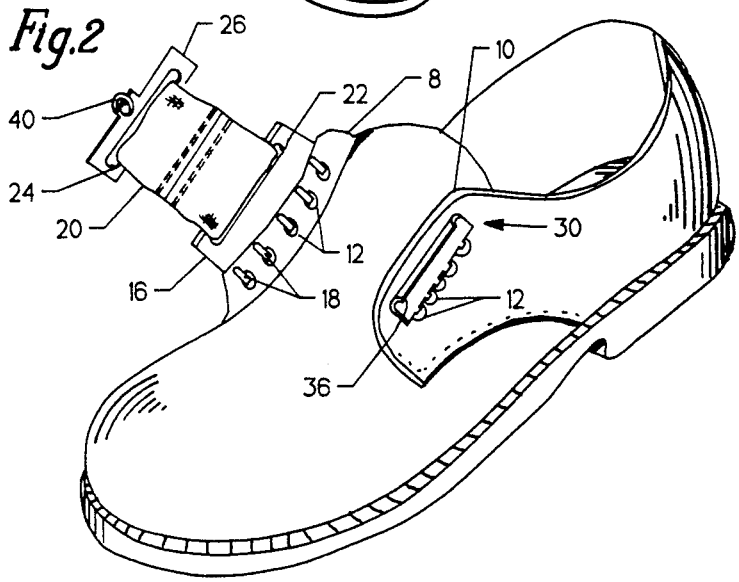
FIG. 2 is a view similar to FIG. 1 in which the device is shown in "open" condition.
Figure 3:
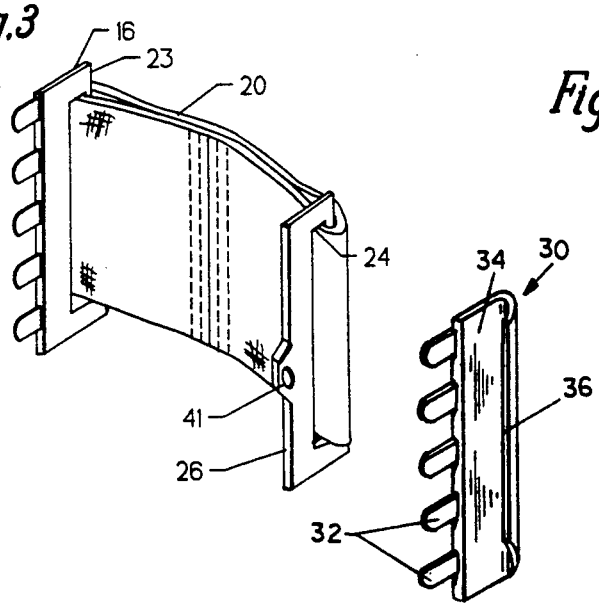
FIG. 3 is a perspective view showing the components of the fastener separated from the shoe.
Figure 4:
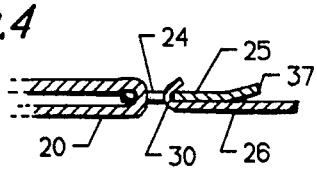
FIG. 4 is a section, on an enlarged scale, taken along line 4—4 of FIG. 1.

The fastener comprises an elongated, rectangular mounting plate 16 with bendable tabs 18 extending from one edge of the plate for engaging the eyelets 12 for attachment of the plate 16 to flap 8 of the shoe, as best depicted in FIG. 2 of the drawing. Elastic means, such as a web or band 20 is looped through a rectangular slot 22 located adjacent the outer edge 23 of the mounting plate 16. The web is of sufficient width to extend over the eyelets 12 and the length to span the tongue or instep portion of the shoe. The free end of the band 20 extends through an elongated slot 24 in a generally rectangular catch plate 26. As best depicted in FIG. 3, a latch plate 30 includes, along its inner edge, a plurality of outwardly extending, bendable tabs 32, each adapted to be fitted through eyelets 12 in flap 10 and bent upwardly to lay flat against the underside of the flap. The latch plate includes a generally planar inner portion 34 and a reversibly curved lip portion 36 adapted to fit through the slot 24 of the catch plate 26 and the edge portion 25 of the catch plate is securely held thereunder, as best depicted in FIG. 4 of the drawing. In essence, slot 24 of the catch plate 26 and the lip portion 36 of the latch plate each provide interengageable detent means for releasably securing the fastener in "closed" condition. The outer edge portion of plate 26 is of sufficient width so that it will extend beyond the edge of lip 36 and may include an upwardly inclined portion 37 so that it may be easily grasped for releasing the plate 26 from its fastened position with the lip 36 of latch plate 30.

After the mounting plate 16 has been affixed to the flap 8 of the shoe and the latch plate has been similarly mounted on the flap 10 of the shoe, the fastener will be ready for use. By simply grasping the catch plate 26 and stretching the elastic band 20 across the tongue of the shoe, the slot 24 may, in one easy and simple motion, be fitted over the outer edge portion of lip 36 of the latch plate 30. For opening the shoe, one would simply grasp the upwardly inclined outer edge portion 37 (FIG. 4) of the catch plate 26 and, in one motion, lift it off of the lip of the latch plate 30.

For persons having some physical disabilities whereby they are unable to lace their shoes or do so only with difficulty or discomfort, a ring 40 may be provided as an option and fitted through a hole 41 (FIG. 3) in the outer edge of the catch plate 26. A wand 42 may be provided as an accessory to the fastener and has a hook 44 at one end that is adapted to engage ring 40 of the catch plate. With this wand, the user may engage the ring 40 of the catch plate using the hook 44 on wand 42 to stretch the elastic web 20 across the tongue of the shoe and fit the slot 24 of the catch plate 26 over the lip of the latch plate 30. To "open" the shoe, this procedure is merely reversed.

Shoe closure devices embodying this invention may be marketed, per se, in the form of a kit for retrofitting of existing shoes and which includes the mounting plate, the elastic band and the catch plate in assembled relation and the latch plate, as shown in FIG. 3. The mounting plate 16 may be mounted on one of the eyelet flaps of the shoe by fitting the tabs through the eyelet holes and bending them over with a pair of pliers or the suitable tool. Similarly, the catch plate may be mounted on the other eyelet of the shoe. Upon completion of these simple steps, the closure device is ready for extended use and will generally last for the life of the shoes to which it is fitted.

It is contemplated that the elastic web or band 20 will be provided in various colors, textures and finishes, such as black, brown and white or neutral shades so that the band will blend with or, if desired, may be made to contrast with the overall appearance of the shoe. It is also contemplated that some sort of leather cover panel may be provided which will fit over the elastic band and be connected thereto by various means to cover over the band and the catch plates to present a neat and smart appearance.

FIGS. 5 and 6 show an alternate embodiment in which a metal spring 50, of generally sinusoidal configuration, has one leg 51 fitted into a cylindrical, tubular member 52 formed along the outer edge of mounting plate 54. To prevent disassembly of these parts, the outer end of leg 51 has an enlarged head portion 53. This device can be used by expanding or tensioning the spring 50 across the tongue portion of the shoe and fitting under the lip portion of the latch plate 30. The terminal end of leg 56 includes a crooked toe portion 58 which serves to ensure against the spring slipping out of engagement with the lip portion 36 of latch plate 30.

In FIGS. 7 and 8, another alternate embodiment of this invention is shown in which a coil spring loop 60 is mounted at one end to the cylindrical tube 52 disposed along the edge of the mounting plate 54 and secured to one of the flaps of the shoe. The latch plate 30 on the other flap may be identical to that previously described. To use this device, one need only to grasp the free end of the coil spring 60 and stretch it outwardly and fit it over the inturned edge 36 of the latch plate 30.

In FIGS. 9 and 10, a further alternate embodiment is shown which includes elastic strand 70 threaded sequentially through a plurality of holes 74 provided along the outer edge of the mounting plate 72 and also through a plurality of equally spaced holes 76 provided along the edge of the catch plate 77 which also includes an elongated slot 79 to receive the lip of latch plate 82. In lieu of bendable tabs 18 used to install the mounting plate as heretofore described, a plurality of holes 78 are disposed along the inner edge of the plate 72 and which may be elongated, as shown, to facilitate registration with the eyelets of the shoe. Each of the holes is adapted to receive a rivet 80 of the "pop" type. Latch plate 82 is also provided with one or more holes 81 adapted to receive rivets 80 for attachment to the flaps 8 and 10 of the shoe. Although holes 81 are shown as round, they could, if necessary or desirable, be elongated as are holes 78 on mounting plate 72. In fasteners which employ bendable tabs, it is preferable that the mounting plate and latch plate be fabricated of metal whereas when rivets are used, the plates may be made of metal or fiber reinforced synthetic plastic material.

While the use of the tabs or rivets may be preferable from the standpoint of applying the fastener to the eyelets of an existing shoe, it is also expected that this invention may also be utilized by dress, sport and athletic shoe manufacturers to create new lines of shoes which will not use conventional laces. In such event, it is expected that a non-metallic mounting plate portion of the fastener could be actually secured between the plies of one flap 8 of a shoe by stitching, riveting or any combination thereof. The latch plate 30 could also be non-metallic and secured between the layers or plies of the leather fabric forming the flap 10 of the shoe so that the outer edge of the latch plate, that is the upwardly and outwardly extending lip portion, would extend from the edge of the flap 10. Accordingly, the only portions of the fastening device which would be visible to the user would be the elastic web 20, the catch plate 26 and the lip portion 36 of the latch plate. In this connection, the original equipment manufacturer could also decorate the web to conform with the color and style of the shoe itself.

In any case, the various fasteners embodying this invention are not only easy to apply, but of paramount importance, are extremely comfortable while being easy to use, most durable and attractive in appearance.

Having thus described my invention, what is claimed is

1. A fastener device in combination with a shoe, said fastener device releasably interconnecting first and second closure flaps of said shoe, each closure flap having an longitudinal inner edge portion with a plurality of eyelets disposed in spaced relation adjacent the longitudinal inner edge, the device comprising:

(a) a first plate spanning substantially the length of the longitudinal inner edge portion of the first closure flap comprising a plurality of tabs extending from an edge of said first plate and an elongated slot generally parallel to said edge, said tabs being adapted to extend through the eyelets to fasten said first plate to the first closure flap;

(b) a second plate spanning substantially the length of the longitudinal inner edge portion of the second closure flap comprising a plurality of tabs extending from said second plate and being adapted to extend through the eyelets to fasten said second plate to the second closure flap and an unitary lip portion spanning substantially the length of the longitudinal inner edge portion of the second closure flap.

(c) a catch plate having an elongated slot of a length and a width adapted to accommodate therein said lip portion of said second plate; and (d) a unitary elastic web connected at one end to said catch plate and at a second end to the first plate and spanning not substantially less than the length of the longitudinal inner edge portion of the first closure flap for releasably retaining said catch plate in engaged relation with said lip portion of said second plate with said unitary elastic web in tension.

2. The fastener device of claim 1, wherein said unitary elastic web is adapted to extend through said elongated slot of said first plate and said elongated slot of said catch plate.

* * * * *